US005520487A

United States Patent [19]

Decker

[11] Patent Number: 5,520,487

[45] Date of Patent: May 28, 1996

[54] WATERPROOF CLUTCHES FOR SHEET PILES

[75] Inventor: Jean Decker, Kayl, Luxembourg

[73] Assignee: Arbed S.A., Luxembourg

[21] Appl. No.: 269,173

[22] Filed: Jun. 30, 1994

[30] Foreign Application Priority Data

Jul. 7, 1993 [LU] Luxembourg ..... 88 367

[51] Int. Cl.[6] ..... E02D 5/14

[52] U.S. Cl. ..... 405/278; 405/279

[58] Field of Search ..... 405/274, 276, 405/277, 278, 279, 280, 281

[56] References Cited

U.S. PATENT DOCUMENTS

| | | | |
|---|---|---|---|
| 866,082 | 9/1907 | Stevens | 405/277 |
| 3,302,412 | 2/1967 | Hunsucker | 405/279 X |
| 5,163,785 | 11/1992 | Zanelli et al. | 405/279 X |

FOREIGN PATENT DOCUMENTS

| | | | |
|---|---|---|---|
| 0264527 | 4/1988 | European Pat. Off. . | |
| 2142957 | 3/1973 | Germany . | |
| 2700414 | 7/1978 | Germany . | |
| 2722978 | 11/1978 | Germany . | |
| 2815236 | 10/1979 | Germany . | |
| 59-88530 | 5/1984 | Japan . | |
| 6600355 | 7/1967 | Netherlands . | |
| 16403 | of 1914 | United Kingdom | 405/281 |
| 481261 | 3/1938 | United Kingdom | 405/278 |

*Primary Examiner*—David J. Bagnell
*Attorney, Agent, or Firm*—Fishman, Dionne & Cantor

[57] ABSTRACT

A waterproof clutch for sheet piles is presented wherein at least one of a pair of clutches has a groove in which a seal is housed.

7 Claims, 1 Drawing Sheet

WATERPROOF CLUTCHES FOR SHEET PILES

BACKGROUND OF THE INVENTION

This invention relates generally to sheet-pile wall assemblies. More particularly, this invention relates to sheet-pile clutches equipped with a waterproof seal resistant to scrapping of the seal during assembly or driving of the interlocking clutches when assembling the sheet-pile wall.

Sheet-pile walls are assembled from a plurality of steel profiles which are connected to one another by interlocking clutches. These interlocking clutches have a certain play in order to allow the clutches to slide, one inside the other, when assembling the sheet-pile wall. Because of this tolerance, sheet-pile clutches are waterproof only under certain conditions.

However, once the conditions of the job site require that the sheet-pile wall be waterproofed, either totally or as much as possible, additional waterproofing measures must be provided for the aforementioned clutches.

It has been attempted to render sheet-pile walls waterproof, as described in the published German Patent Application DE-OS-2,142,957, by injecting, on site and before the sheet piles are driven in, a compound into a clutch of the sheet piles, the compound being applied in the liquid state and solidifying in the form of a foam with an elastic consistency. Alternatively, it is possible to follow the granted and published German Patent Application DE-AS-2,722,978 in which a seal resistant to shearing is formed, in the clutch before it is inserted, by injecting an appropriate product into the clutch and by spreading this product evenly by means of a movable device, which, at the same time gives the product the desired shape. As these seals are very sensitive, the sheet piles can only be placed in position by being driven in by pile driving means but not by vibration means. In German Patent DE-PS-2,815,236-C2, a method is describedwhich can be used on site and which is performed as follows: before a sheet-pile element is driven in, a glue is introduced into the clutch which has not been engaged, the chamber of this part of the clutch is closed off with a calibrating element to protect the glue and to prevent earth from entering the clutch and, once the sheet pile has been driven in to the desired depth, the calibrating element is withdrawn after the driving in is completed.

In still another method in accordance with the published German Patent Application DE-OS-2,700,414, a seal is applied against one of the faces of the clutch on which it is expected that an excess pressure or other comparable force will act.

The above-mentioned methods have the major disadvantage that the seal in the end has very little resistance to shearing. When the sheet piles are placed in position, whether by being driven in or by vibration, the clutches rub against one another and the seals are destroyed, at least partially, by the seal being scraped away or other forms of damage.

It is obvious that there is a great need to provide sheet-pile clutches that are equipped with means to provide a seal that is resistant to being scraped away when the clutches are inserted into one another.

SUMMARY OF THE INVENTION

This above-discussed and other problems and deficiencies of the prior art are overcome or alleviated by the waterproof clutches for sheet piles of the present invention. In accordance with the present invention, a waterproof clutch for sheet piles is presented wherein there is at least one housing situated inside the clutch in which at least one seal is housed.

One of the main advantages of the present invention is that the seal is situated inside a housing. It is thus protected against shearing and scraping away when the sheet-pile clutches are inserted into one another.

In accordance with a first advantageous embodiment of this invention, the seal used is made from a swellable or expandable material.

One of the advantages of a swellable or expandable seal situated inside a housing is that after the sheet-pile wall has been placed in position, the seal, by expanding or swelling, presses with great force against the opposite wall and thus improves the waterproofness of the clutch. This seal can be applied in the factory in which the sheet piles are manufactured, or, alternatively on site before the sheet piles are inserted into one another.

In accordance with a second preferred embodiment, the seal used is in the form of a strip, preferably made from a resilient material such as rubber. The seal used can also be made from a pasty material. In principle, all conventional seals are suitable.

In accordance with a third preferred embodiment, housings are provided on the two adjacent sides of the clutch. In this way, the radial thickness of the seal can be increased and the water has to traverse a greater obstructed length. As a result, the sheet-pile clutch of this invention, is, therefore, made more waterproof.

The housing preferably consists of a groove in which the seal is placed. In this case, it is advantageous to provide a tongue or a thickened portion which forms an area of increased thickness on the outer side of the sheet-pile clutch. In this way, the thickness of the material forming the clutch will not be any weaker at the location of the groove. This approach prevents the formation of a stressed rupture point within the clutch.

It is also possible, in accordance with another preferred embodiment, to form a tongue or a thickened portion on one side inside the clutch. The projection formed by the tongue then defines two housings, one on each side of the tongue. The tongue protects the seals against shearing when the sheet-pile clutches are inserted into one another.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
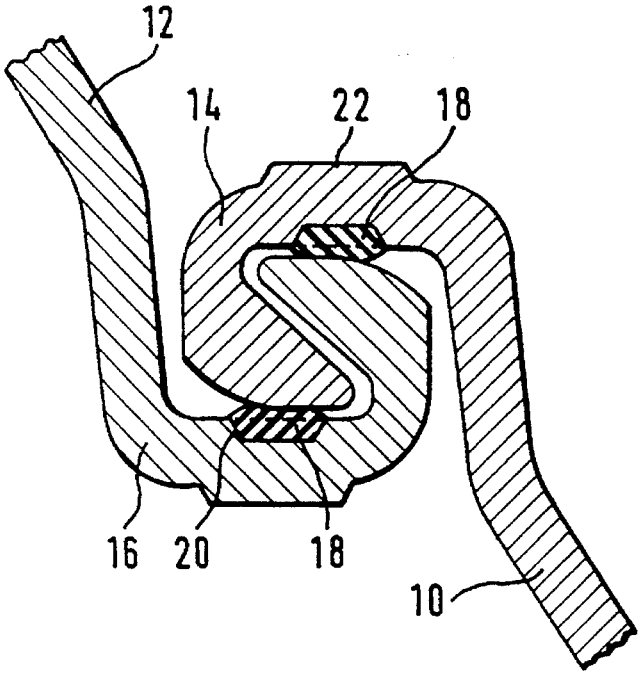
FIG. 1 illustrates a section through a pair of interlocked sheet-pile clutches in accordance with the present invention.

Referring first to FIG. 1, a preferred embodiment of waterproof clutches for sheet piles of the present invention is shown generally by the entire FIG. 1. FIG. 1 shows a section through two sheet piles 10, 12, each equipped with a clutch 14, 16, which clutches interlock. A seal 18 is housed inside a groove 20 formed in the clutches 14, 16. The seal 18 of the clutch 14 is pressed strongly against the clutch 16, and the seal 18 of the clutch 16 is pressed against the clutch 14. It is therefore impossible for any liquid to pass through the clutches of the sheet piles. The seal 18 is protected against shearing when the clutches 14, 16 are inserted into each other by the groove 20 in which it is housed.

A tongue 22 is situated on the same clutch 14 on the opposite side to the groove 20 in order to guarantee a uniform thickness of the wall throughout the clutch 14. In this way, it is possible to prevent the formation of a stressed rupture point within the clutch.

Figure 2:
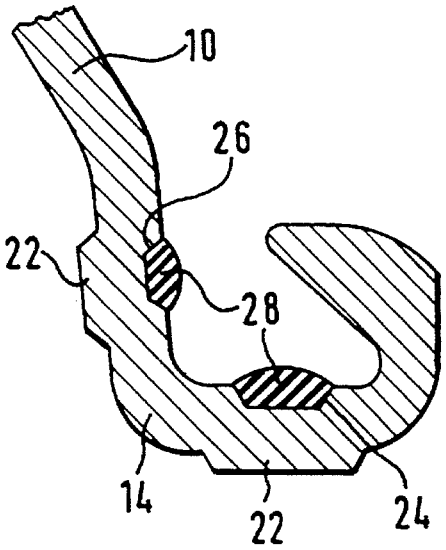
FIG. 2 illustrates a section through a sheet-pile clutch in accordance with another preferred embodiment of the present invention.

Referring now to FIG. 2, another preferred embodiment of the present invention is shown, in which two grooves 24, 26 have been provided on two adjacent sides of the clutch 14. A seal 28 is situated in each of these housings. On the opposite side to the grooves 24, 26 are provided strengthening tongues 22 to increase the mechanical stability of the clutch 14.

Figure 3:
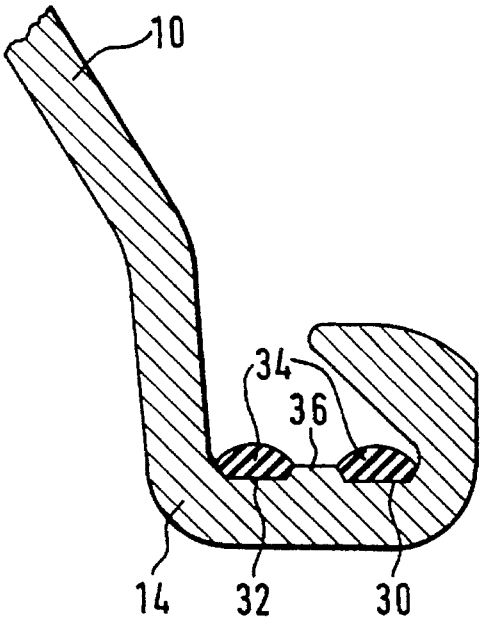
FIG. 3 illustrates a section through a sheet-pile clutch in accordance with another preferred embodiment of the present invention.

FIG. 3 shows still another preferred embodiment in accordance with the present invention of a waterproof clutch for sheet piles. A sheet pile 10 is equipped with a clutch 14 in which two housings 30, 32 for seals 34 are provided on the same side as the clutch. A tongue 36 forming a projection in the middle of one side of the clutch creates two housings 30 and 32 in which the seals 34 are provided. The tongue 36 protects the seals 34 against shearing and/or scraping away when the sheet piles are inserted into one another.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A waterproof clutch for sheet piles comprising:

a clutch;

at least one housing inside the clutch, said housing being a groove located on an inside surface of the clutch;

a thickening tongue situated on a surface of the clutch opposite said groove; and at least one seal housed in said housing.

2. The device of claim 1 wherein said seal comprises at least one expandable seal which is situated in at least one housing.

3. The device of claim 1 wherein the said seal is formed from a material that can swell in water.

4. The device of claim 1, wherein the said seal is a strip made from a resilient material.

5. The device of claim 1 wherein the said seal is a pasty material.

6. A waterproof clutch for sheet piles comprising:

a clutch;

a tongue forming a projection on an inner surface of the clutch which thereby creates two housings along an inner surface of the clutch; and at least one seal housed in one of said housings.

7. The device of claim 6 including at least one seal in each of said two housings.

* * * * *